United States Patent [19]

Kocher et al.

[11] Patent Number: 4,497,181

[45] Date of Patent: Feb. 5, 1985

[54] MEANS TO MEASURE, INDICATE AND REGULATE THICKNESS OF ICE LAYER IN REFRIGERATION SYSTEM

[75] Inventors: Erich J. Kocher; John K. Kopp, both of Milwaukee, Wis.

[73] Assignee: Vilter Manufacturing Corporation, Milwaukee, Wis.

[21] Appl. No.: 503,806

[22] Filed: Jun. 13, 1983

[51] Int. Cl.[3] ..... F25C 1/00; G08B 19/02

[52] U.S. Cl. ..... 62/139; 62/201; 340/580

[58] Field of Search ..... 62/139, 140, 128, 201; 340/580, 581, 582, 583; 33/143 L, 149 J, 150, 169 F; 364/560, 563

[56] References Cited

U.S. PATENT DOCUMENTS

| | | | |
|---|---|---|---|
| 2,355,014 | 8/1944 | Schorn | 62/128 X |
| 2,421,819 | 6/1947 | Vandenberg | 62/139 |
| 2,772,411 | 11/1956 | Cooper | 33/333 |
| 3,228,204 | 1/1966 | Matthies | 62/140 |
| 3,482,320 | 12/1969 | Baker | 33/143 L |
| 3,500,547 | 3/1970 | Van Haagen | 33/143 L |
| 3,878,984 | 4/1975 | Sotiropoulos et al. | 33/172 E X |
| 4,428,206 | 1/1984 | Massa | 62/140 |

*Primary Examiner*—Harry Tanner

*Attorney, Agent, or Firm*—James E. Nilles; Thomas F. Kirby

[57] ABSTRACT

A refrigeration system includes a latent heat storage tank having an evaporator coil or tube submerged in water and on which a layer of ice forms in response to circulation therethrough of refrigerant from a motor-driven compressor. Apparatus is provided to measure, indicate and regulate the thickness of the ice layer. The apparatus comprises an ice sensing device which provides an electric signal proportional to ice layer thickness to an electrical control circuit which then operates a meter to indicate thickness and operates a motor controller to stop or start the compressor motor. The ice sensing device comprises a probe which is periodically movable back and forth in a short arc in one cycle to detect ice by a timer-actuated electric motor and a potentiometer which moves in response to probe movement to provide a signal proportional to ice thickness to the above-mentioned electrical control circuit. Motor control is effected by limit switches and relays and a resettable peak hold circuit to maintain a peak signal value in each cycle despite further movement of the probe and potentiometer.

3 Claims, 7 Drawing Figures

METER RELAY CONTACT ACTION

| | METER POINTER BELOW BOTH SET POINTS | | METER POINTER BETWEEN SET POINTS | | METER POINTER ABOVE BOTH SET POINTS | |
|---|---|---|---|---|---|---|
| | OPEN | CLOSE | OPEN | CLOSE | OPEN | CLOSE |
| M-L LOW SET POINT | | X | X | | X | |
| M-H HIGH SET POINT | | X | | X | X | |
| | | | | | | |

MEANS TO MEASURE, INDICATE AND REGULATE THICKNESS OF ICE LAYER IN REFRIGERATION SYSTEM

BACKGROUND OF THE INVENTION

1. Field of Use

This invention relates generally to refrigeration systems and, in particular, the means to measure, indicate and regulate the thickness of a layer of ice formed in the system.

2. Description of the Prior Art

Some refrigeration systems operate in such a manner that a layer of ice tends to form or build-up on certain components in the system. This build-up may or may not be desirable, depending on the purpose of the system. For example, some air-conditioning systems, dairy cooling systems and other systems wherein constant cooling is required employ a latent heat storage tank wherein ice build-up is desired. A typical latent heat storage tank comprises evaporator coils or tubes which are submerged in water in the tank and on which a layer of ice builds up in response to circulation through the tubes of refrigerant supplied through a condenser from a motor-driven compressor. The refrigerant is then returned from the evaporator to the compressor for recirculation. Typically, the evaporator tubes are on the order of about one-half inch in outside diameter and the thickness of the layer of ice which forms on the exterior of each tube may be as much as one inch thick, measured from exterior surface of the tube to the outer surface of the ice layer. To maintain proper and efficient operation of the system, it is necessary to maintain the thickness of the ice layer within some specified preferred range and this is usually accomplished by intermittently operating the compressor at certain intervals for certain periods of time. This intermittent operation can be accomplished manually by a human operator in response to his visual check of the amount of ice build-up or can be accomplished automatically by compressor control systems which employ devices which sense and measure ice build-up and control compressor operation accordingly. The following U.S. Pat. Nos. illustrate some such prior art control systems: 3,552,136 Cook; 3,898,856 Komedera; 3,360,951 Hoenisch; 2,076,119 Carraway; 2,867,092 Perry; 2,624,180 Grimshaw; 2,622,923 Cobb; 3,672,183 Bernstein; 4,011,733 Kuckens; 3,484,805 Lorenz; 2,187,258 Wood; 3,127,486 Blumenshine; 1,916,315 Hoffman; 2,448,453 Morrison.

SUMMARY OF THE PRESENT INVENTION

In accordance with the present invention there is provided a refrigeration system which employs improved means for measuring, indicating and regulating the thickness of a layer of ice which forms on some component in the refrigeration system. The invention is especially well-suited for use in a latent heat storage tank wherein the component on which the layer of ice forms is a tube submerged in water.

The refrigeration system comprises: a compressor; an electric motor for driving the compressor; a motor controller operable to start and stop the compressor driving motor; an evaporator which is supplied with refrigerant from the compressor and having a portion, such as coils or tubes submerged in water, on which a layer of ice tends to form; and a condensor through which refrigerant is supplied from the compressor to the evaporator and back to the compressor for recirculation.

The means in accordance with the invention for measuring, indicating and regulating the thickness of the layer of ice comprises: an ice sensing probe which is reciprocably movable in a short arc to make physical contact with a layer of ice on an evaporator tube; a potentiometer having an adjustably movable component responsive to the position of the probe; a second electric motor operable to effect reciprocating movement of the probe and corresponding proportional adjustment of the potentiometer; a timer to periodically operate the second motor; circuitry (including relays and limit switches) to effect motor control; an indicating device, such as a meter, providing a indication, such as a visual read-out, of the thickness of the layer of ice; and an electrical control circuit responsive to the adjustment of the potentiometer (i.e., to the position of the probe) to provide output signals to operate the indicating device and to operate the motor controller for the compressor motor.

The ice sensing probe, the second electric motor therefor, the potentiometer and limit switches hereinafter described together form a sensing device in accordance with the invention. The electrical control circuit includes a peak hold circuit to maintain the peak signal value (i.e., a maximum thickness of the ice layer) for each probe sweep so that this information is always available on the indicating device and so that the compressor motor controller stays in the appropriate state (on or off) and does not cycle. The electrical control circuit also includes a reset contact for the peak hold circuit to enable the latter to release the peak signal when it is no longer pertinent or useful. The indicating device is a meter which has adjustable set points and operates compressor start/stop controller.

In operation, the timer periodically (at five minute intervals, for example) turns on the second motor and the ice sensing probe makes a sweep until it touches ice and the potentiometer responds accordingly. The potentiometer signal is received by the peak hold circuit and the meter indicates ice thickness and the compressor is started or stopped, depending upon requirements. The limit switches operate to sequence the motor after the probe reaches the ice and causes the probe to move away from the ice in preparation for the next sweep. The compressor continues to run (or runs intermittently) until ice layer thickness reaches some predetermined high range, whereupon compressor operation will be automatically stopped. The compressor will be restarted when the ice melts and the thickness of the layer is reduced to some predetermined low range.

The means in accordance with the present invention offers several advantages over the prior art. Unlike some prior art systems which employ timers to turn the compressor on and off at fixed time intervals, the present invention uses a timer only to establish regular periods for sampling and measuring ice build-up but relies on the actual measured ice layer thickness to control compressor operation. Thus, the invention provides a more responsive, accurate and stable system. Furthermore, the invention employs an improved type of movable sensing probe which actually 'feels' the amount of ice build-up and does not rely on optical sensing devices or on those devices which measure electrical conditions such as voltage, current, resistance or capacitance. Such devices only inferentially sense icing and are subject to false indications resulting from murky water, defective lighting, water contamination and so forth. The present invention not only effects automatic compressor control but, unlike prior art systems, also provides quantative information (visual or audio) as to the thickness of the layer of ice to the human operator or monitor of the refrigerating system so that such person has a full understanding of system conditions and can plan or act accordingly. The invention, although substantially more sophisticated from the operational standpoint than the prior art, is relatively economical and easy to manufacture (using state of the art electrical and electronic components) and is reliable in use. Other objects and advantages of the invention will hereinafter appear.

DRAWINGS

DESCRIPTION OF A PREFERRED EMBODIMENT

Figure 1:
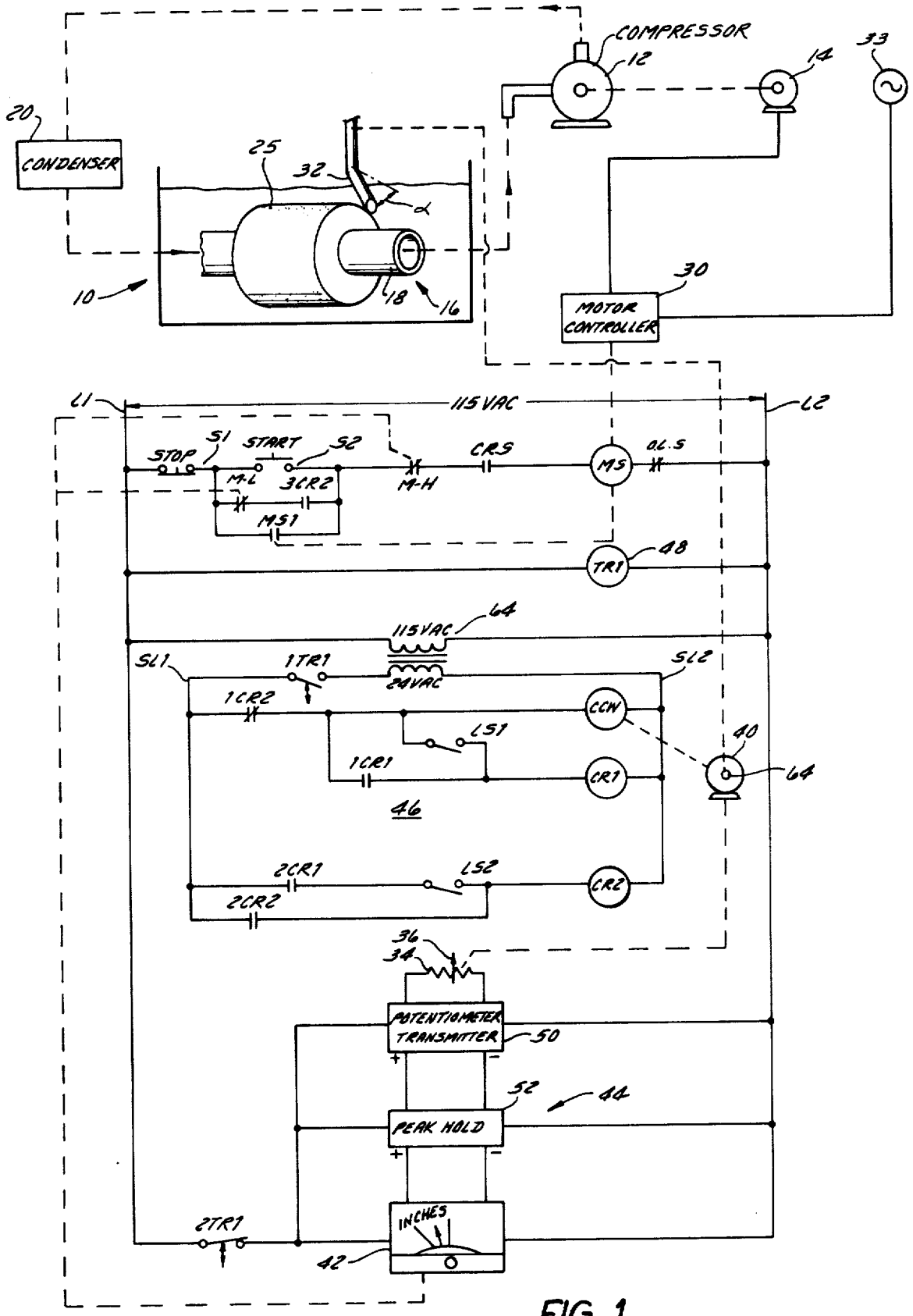
FIG. 1 is a schematic diagram of means, including a sensing device and other components, in accordance with the invention for measuring, indicating and regulating the thickness of a layer of ice formed in a refrigeration system which includes a latent heat storage tank.
Figure 2:
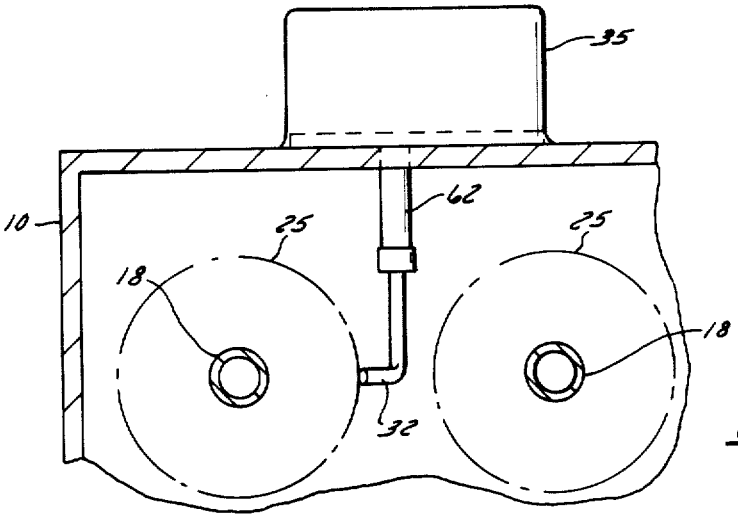
FIG. 2 is a cross-section view of a portion of the latent heat storage tank in FIG. 1 and showing an evaporator tube with an ice sensor probe of a sensing device in accordance with the invention mounted in association therewith.

Referring to FIG. 1, there is shown a refrigeration system which employs improved means in accordance with the present invention for measuring, indicating and regulating the thickness of a layer of ice formed on a coil, pipe or tube 18 in a latent heat storage tank 10 in the refrigeration system.

The refrigeration system comprises: a compressor 12; an electric motor 14 for driving the compressor 12; a motor controller 30 for energizing the compressor motor 14 from a suitable source of electric power 33; an evaporator 16 supplied with refrigerant through a condenser 20 from the compressor 12 and having a portion, such as a coil, pipe or tube 18 submerged in water in tank 10 and on which a layer of ice 25 tends to form; and refrigerant is returned from the evaporator 16 to the compressor 12 for recirculation.

The improved means in accordance with the invention comprises: an ice sensing probe 32 which is reciprocably movable through an angle $\alpha$ to make contact with the layer of ice 25 on evaporator tube 18; a potentiometer 34 having a rotatable shaft 36; a second electric motor 40 operable to effect reciprocating angular movement of the ice sensing probe 32 and corresponding proportional movement of the rotatable potentiometer shaft 36; an indicating device 42 providing an indication of the thickness of the ice layer 25, such as a meter giving a visual display or read-out; and an electrical control circuit 44 responsive to the signal from the potentiometer 34 to provide output signals to operate the indicating device or meter 42 and, through meter 42, to operate the motor controller 30 for the compressor motor 14.

The probe 32, motor 40, potentiometer 34 and other components hereinafter described together form an ice thickness sensing device 35.

The power supply lines L1 and L2 serve to supply operating power for the second electric motor 40, the indicating device 42, the electrical control circuit 44, and the apparatus 46 hereinafter described.

Figure 3:
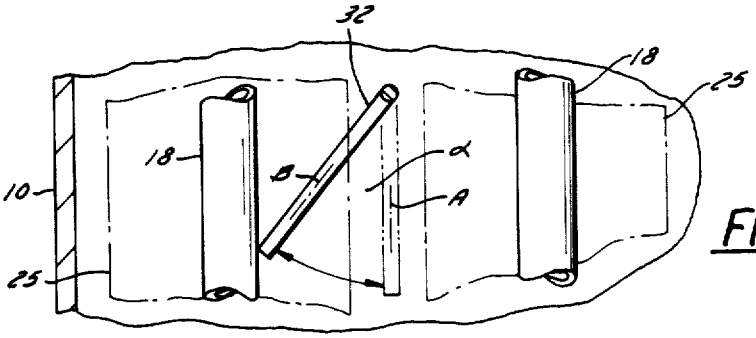
FIG. 3 is a top plan view taken on line 3—3 of FIG. 2.

The apparatus 46 includes a timer 48 to periodically energize and operate the motor 40 to measure the thickness of the layer of ice 25, and to enable corrective action to be initiated, if necessary, by the electrical control circuit 44. The apparatus 46 includes relays and limit switches, hereinafter described, to effect sequencing of motor 40 so that the sensing probe 32 can sweep back and forth through an arc or angle $\alpha$ for one cycle of operation to measure ice thickness in its path of movement. Such periodic movement also prevents freeze-up of the sensing probe 32 itself. During one cycle, probe 32 moves from a starting position A shown in FIG. 3 in dotted lines, to some other position B shown in FIG. 3 in solid lines, and then back to starting position A. Position B varies in location and is a function of the thickness of the ice layer 25.

The electrical control circuit 44 includes a potentiometer transmitter 50 to which potentiometer 34 is connected, a peak hold circuit 52 connected to receive the potentiometer output signal from transmitter 50, and a reset contact 2TR1 for the peak hold circuit. The indicating device or meter 42 is connected to receive output signals from peak hold circuit 52 to provide a read-out and to effect operation of motor controller 30. The peak hold circuit 52 operates to maintain the peak signal value (which signifies maximum ice layer thickness sensed) during each sweep or cycle of the sensing probe 32 so that this information is always available on the indicating device 42 and so that the motor controller 30 for the compressor motor 14 stays in the appropriate state (on or off) and does not turn on and off in response to changes in signal value from potentiometer 34. The electrical control circuit 44 also includes a reset contact 2TR1 for the peak hold circuit 52 to enable the latter to release the peak signal when it is no longer pertinent or useful, i.e., in readiness for a new cycle.

Figure 7:
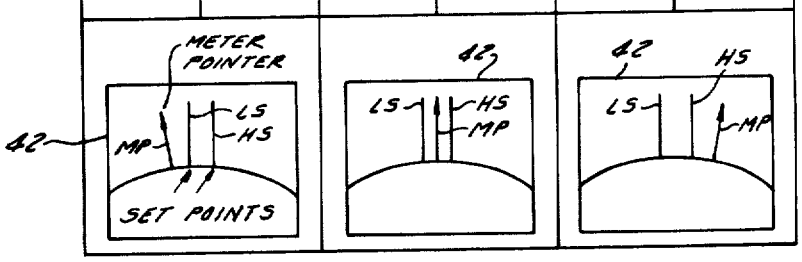
FIG. 7 is a chart depicting meter relay contact action for the meter of FIG. 1.
Figure 6:
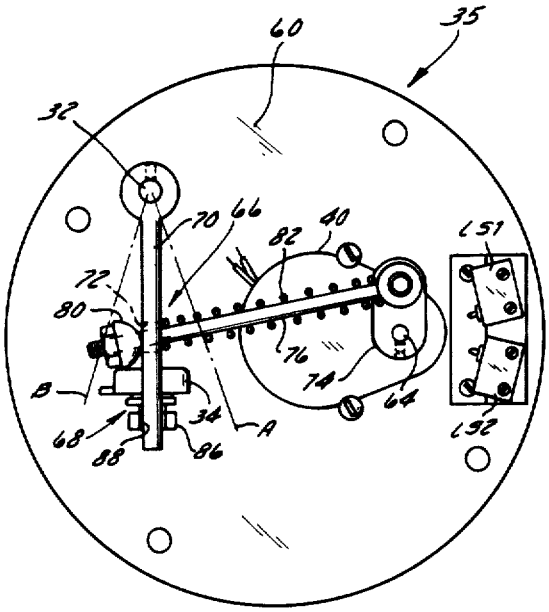
FIG. 6 is a top plan view of the sensing device of FIGS. 4 and 5.
Figure 4:
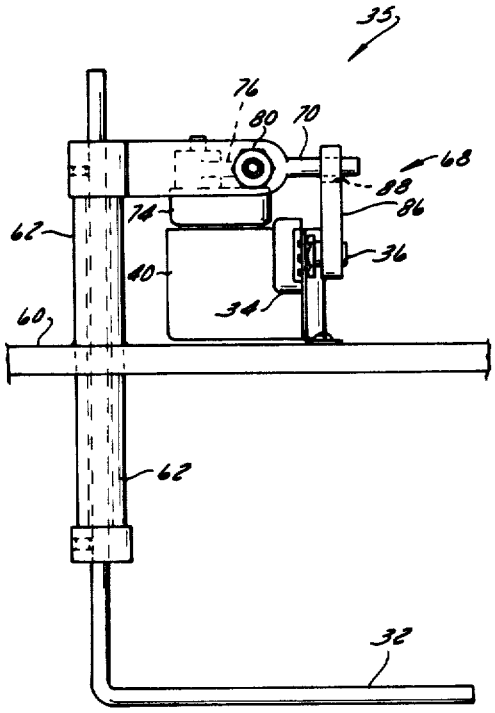
FIG. 4 is an enlarged side elevation view of the sensing device of FIG. 2 with the cover removed to show interior details.
Figure 5:
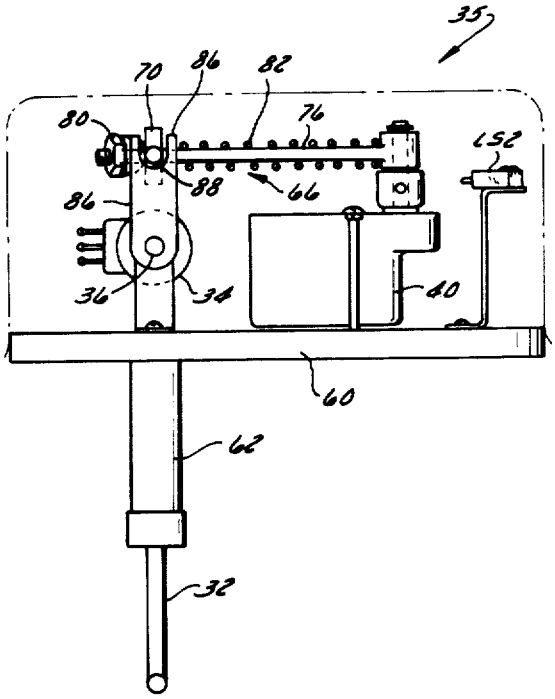
FIG. 5 is an end elevation view of the device of FIG. 4.

As FIGS. 1 and 7 show, the meter 42 has relay output contacts M-L (normally closed) and M-H (normally closed) which operate to turn compressor motor 14 (and compressor 12) on and off at desired ice thicknesses. Normally closed reset contact 2TR1 is connected in circuit between meter 42 and supply line L1. A controller relay coil MS, which is energizable to actuate motor controller 30 and start compressor motor 14, is connected across power supply lines L1 and L2 in series circuit with a normally closed spring-biased pushbutton type stop switch S1, a normally open spring-biased pushbutton type start switch S2, the normally closed meter relay contacts M-H, a normally open compressor safety switch CRS, and a normally closed motor overload switch OLS. The normally closed meter relay contacts M-L and normally open control sequence contacts 3CR2 are connected in series across start switch S2. The normally open holding contacts MS1 of controller relay coil MS are connected across contacts M-L and 3CR2.

As FIG. 7 shows, meter 42 has adjustable set points LS and HS and a meter pointer MP. The chart in FIG.

7 indicates three different pointer conditions with respect to the set points and also indicates the status (open or closed) of the relay contacts M-L and M-H under the several conditions.

As FIGS. 2 through 6 show, ice thickness sensing device 35 comprises: a support or base plate 60; the L-shaped probe 32 which is rotatably mounted in a sleeve 62 on the support; the electric motor 40 which is mounted on the support and has a rotatable motor shaft 64; and a drive linkage 66 connected between motor shaft 64 and probe 32 and operable in response to rotation of the motor shaft in one direction to rotate the probe from starting position A through angle $\alpha$ to second position B and further operable in response to rotation of the motor shaft in the same direction to rotate probe from second position B to starting position A. Device 35 further comprises potentiometer 34 which is mounted on support 60 and has the rotatable potentiometer shaft 36. Drive means 68 are connected between drive linkage 66 and potentiometer shaft 36 whereby rotation of probe 32 is accompanied by proportional rotation of the potentiometer shaft and a change in output signal. The drive linkage 66 comprises: a rigid drive member 70 connected to and extending radially from probe 32, and the rigid drive member has an aperture 72 therein. A link 74 is connected to and rotatable by motor shaft 64. A drive rod 76 has one end pivotally connected to link 74 and has its other end extending through aperture 72 in rigid drive member 70 in sliding relationship. An abutment means 80 on drive rod 76 prevents the other end thereof from being withdrawn from the aperture 72. A helical compression spring 82 is disposed around the drive rod 76 between link 74 and the rigid drive member 70. The drive means 68 comprises a shaft link 86 having one end rigidly secured to potentiometer shaft 36 and having at its other end engaging means such as slot 88 whereby it is connected for movement by rigid drive member 70. The engaging means slot 88 is formed in shaft link 86 and the end of rigid drive member 70 is slidably engaged therein.

As FIG. 1 shows, the motor 40 has its shaft 64 connected by hereinbefore-described mechanical linkage 68 and drive means 66 to the movable component 36 of potentiometer 34 and to the sensing probe 32, respectively. The motor 40 has a first winding CCW energizable to drive the motor in counterclockwise direction. It is to be understood that motor 40 operates at a very slow rpm which, for example, is on the order of one revolution per minute (1 rpm).

As FIG. 1 further shows, the coil TR1 of timer 48 is connected for energization across power supply lines L1 and L2 and has a normally open timer contact 1TR1 and a normally closed timer contact 2TR1 which can be adjusted or set to operate (open and close) repeatedly according to some predetermined schedule, i.e., open (or closed) for five minutes and closed (or open) for one minute, for example.

A step-down transformer 64 has its primary winding connected across the power supply lines L1 and L2. The secondary winding of transformer 64 includes one output terminal which is connectable to a step-down power supply line SL1 through the timer contact 1TR1. The other output terminal of secondary winding of transformer 64 is connected to a step-down power supply line SL2. The motor winding CCW of motor 40, a sequence control relay CR1 and its contacts 1CR1 and 2CR1, a sequence control relay CR2 and its contacts 1CR2, 2CR2 and a pair of double pole single throw limit switches LS1 and LS2 are connected across the step-down power lines SL1 and SL2 in the following manner and are mounted on support plate 60 of device 35 for actuation by probe 32.

Counter-clockwise motor winding CCW is connected in series with normally closed 1CR2 contact, across lines SL1 and SL2.

The coil of sequence control relay CR1 is connected in series with normally open relay contact 1CR1 and normally closed relay contact 1CR2 across lines SL1 and SL2.

The normally open limit switch contact LS1 is connected in parallel with contact 1CR1.

The coil of sequence control relay CR2 is connected in series with normally open limit switch contact LS2 and contact 2CR1 between lines SL1 and SL2.

The normally open sequence control relay contact 2CR2 is connected in parallel with contacts 2CR1 and LS2.

Operation

In operation, the timer 48 periodically (at five minute intervals, for example) turns on the motor 40 and the sensing probe 32 makes an angular sweep. When ice build-up is detected, the potentiometer 34 responds accordingly. The meter 42 indicates ice thickness and the compressor 12 is operated in response to the signal which operates motor controller 30 to start or stop motor 14. This measuring occurs at regular intervals. The travel of the sensing probe 32 towards the evaporator tube 18 is stopped by the ice and the meter 42 displays this information (received as a signal from potentiometer 34) as ice thickness. The compressor 12 runs until ice build-up reaches the predetermined upper setpoint thickness, whereupon compressor operation automatically stops. The compressor 12 will restart when the ice melts below a predetermined lower setpoint thickness.

As FIGS. 1 and 7 make clear, the sequence of operation of the circuits 44 and 46 is as follows. (1) Contacts M-H and M-L open at high and low setpoint of ice thickness as shown in FIG. 7. (2) Contact 1TR1 closes. The CCW winding of motor 40 is energized. The LS2 limit switch is hit by link 74 of probe 32. The limit switch contact LS1 now flips from open to close energizing CR1 relay starting the sequence or cycle of operation. (3) The 1CR1 contact and the 2CR1 contacts both close. Pivotal movement of probe 32 continues until it hits the ice layer. Potentiometer shaft 36 moves in proportion to the distance of travel of the probe 32. The value of the potentiometer signal is sensed by peak hold circuit 52 which in turn sends a proportional signal to the meter 42 indicating ice thickness. (4) The CCW winding of motor 40 is energized until the LS2 limit switches are hit by probe 32. These contacts (LS2) now flip from open to close, energizing relay CR2 and de-energizing the CCW winding. In other words, the CCW winding remains energized and motor 40 continues to turn until the pivot arm 32 (i.e. link 74) actuates limit switch LS2. Since contact 2CR1 is closed, coil CR2 is energized. Contact 2CR2 closes to latch coil CR2 in the energized state. Contact 1CR2 opens, thus de-energizing coil CCW and turning off motor 40. At this point, the CCW winding has brought the probe 32 away from the ice. The sequence is now complete. (5) Note: The normally closed timer contact 2TR1 in series with meter 42 opens momentarily at the beginning of each sequence to insure a new reading. (6) Note: The normally open contact 3CR2 in series with meter relay contact M-L insures that the compressor-starter MS, if de-energized, is not falsely energized when timer contact 2TR1 resets the meter relay 42 in preparation for a new reading.

In an actual embodiment of the apparatus disclosed herein timer unit 48 took the form of a model no. 76-02-A6-25-00 (120 v, 60 Hz) timer available from Eagle Signal Industrial Controls, 736 Federal Street, Davenport, Iowa 52803.

The motor 40 took the form of a motor identified as part no. Z12-C-10-30 or 15 sec. cycle, available from Hansen Manufacturing Co., 1934 Virgil Boulevard, Princeton, Ind. 47570.

The meter 42 took the form of a model no. 3324A1XA cat. no. 21423 meter available from Simpson Electric Co., 853 Dundee Avenue, Elgin, Ill. 60120.

We claim:

1. In a refrigeration system: a compressor; a first electric motor for driving said compressor; an evaporator for receiving refrigerant from said compressor, said evaporator having a portion which is submersible in water in a tank and is susceptible to formation of a layer of ice thereon; a compressor motor controller operable to energize and de-energize said first electric motor; and means for measuring, indicating and regulating the thickness of said layer of ice and comprising:

a movable probe extendible into the water in said tank for contacting said layer of ice, said probe being reciprocably movable during one cycle of operation from a starting position, to an ice contacting position and back to said starting position; a potentiometer responsive to movement of said probe to provide a signal proportional to probe position; a second electric motor energizable to effect movement of said probe; timing means to effect energization of said second electric motor at periodic intervals of time to effect one cycle of operation of said probe for each periodic energization of said second electric motor; an indicator device operable to provide an indication of the thickness of said layer of ice; and an electrical control circuit comprising a peak hold circuit to derive a peak value signal received from said potentiometer during each cycle of operation of said probe and to maintain said peak value signal for a predetermined interval of time after said each cycle of operation; and for providing a signal to operate said indicator device and to operate said compressor motor controller for said first electric motor.

2. A system according to claim 1 including limit switch means to effect operation of said second electric motor for one cycle of operation of said probe.

3. A system according to claim 2 wherein said indicator device is a meter which provides a visual display.

* * * * *